US006102034A

United States Patent [19]

Bühlmann

[11] Patent Number: 6,102,034

[45] Date of Patent: Aug. 15, 2000

[54] BREATHING EQUIPMENT

[75] Inventor: Pierre Bühlmann, Hövdingevägen, Sweden

[73] Assignee: Interspiro AB, Lidingö, Sweden

[21] Appl. No.: 08/983,121

[22] PCT Filed: Jun. 27, 1996

[86] PCT No.: PCT/SE96/00853

§ 371 Date: Feb. 26, 1998

§ 102(e) Date: Feb. 26, 1998

[87] PCT Pub. No.: WO97/02069

PCT Pub. Date: Jan. 23, 1997

[30] Foreign Application Priority Data

Jul. 5, 1995 [SE] Sweden ..... 9502440

[51] Int. Cl.[7] ..... A62B 7/02

[52] U.S. Cl. ..... 128/201.29; 128/201.13; 128/205.17; 128/205.25; 128/205.27

[58] Field of Search ..... 128/201.29, 201.13, 128/201.14, 201.15, 201.21, 201.22, 201.23, 201.24, 201.25, 205.17, 205.25, 205.27, 205.16, 206.12, 206.21

[56] References Cited

U.S. PATENT DOCUMENTS 4,440,163 4/1984 Spergel ..... 128/205.13
4,926,855 5/1990 Hellquist et al. ..... 128/201.28
4,998,529 3/1991 Werjefelt ..... 128/201.13
5,526,804 6/1996 Ottestad ..... 128/201.25

FOREIGN PATENT DOCUMENTS

470791 A2 12/1992 European Pat. Off. ..... 128/201.25
2 247 396 of 1992 United Kingdom .

*Primary Examiner*—John G. Weiss
*Assistant Examiner*—V. Srivastava
*Attorney, Agent, or Firm*—Pollock, Vande Sande & Amernick, R.L.L.P.

[57] ABSTRACT

Breathing equipment including a breathing hood to surround a wearer's head. An inner mask covers at least the wearer's mouth and nose. The equipment includes a breathing gas delivery conduit and structure to permit gas to pass from the hood to the mask. A check valve allows gas to pass from the mask to the surroundings when overpressure in the mask has reached a given value. The breathing gas is delivered to the hood and the gas passing structure permits gas to pass in both directions between the hood and the mask. The gas passing structure requires a lower overpressure in the mask for passage of gas from the mask to the hood than the pressure required for the check valve to release gas to the surroundings.

8 Claims, 1 Drawing Sheet

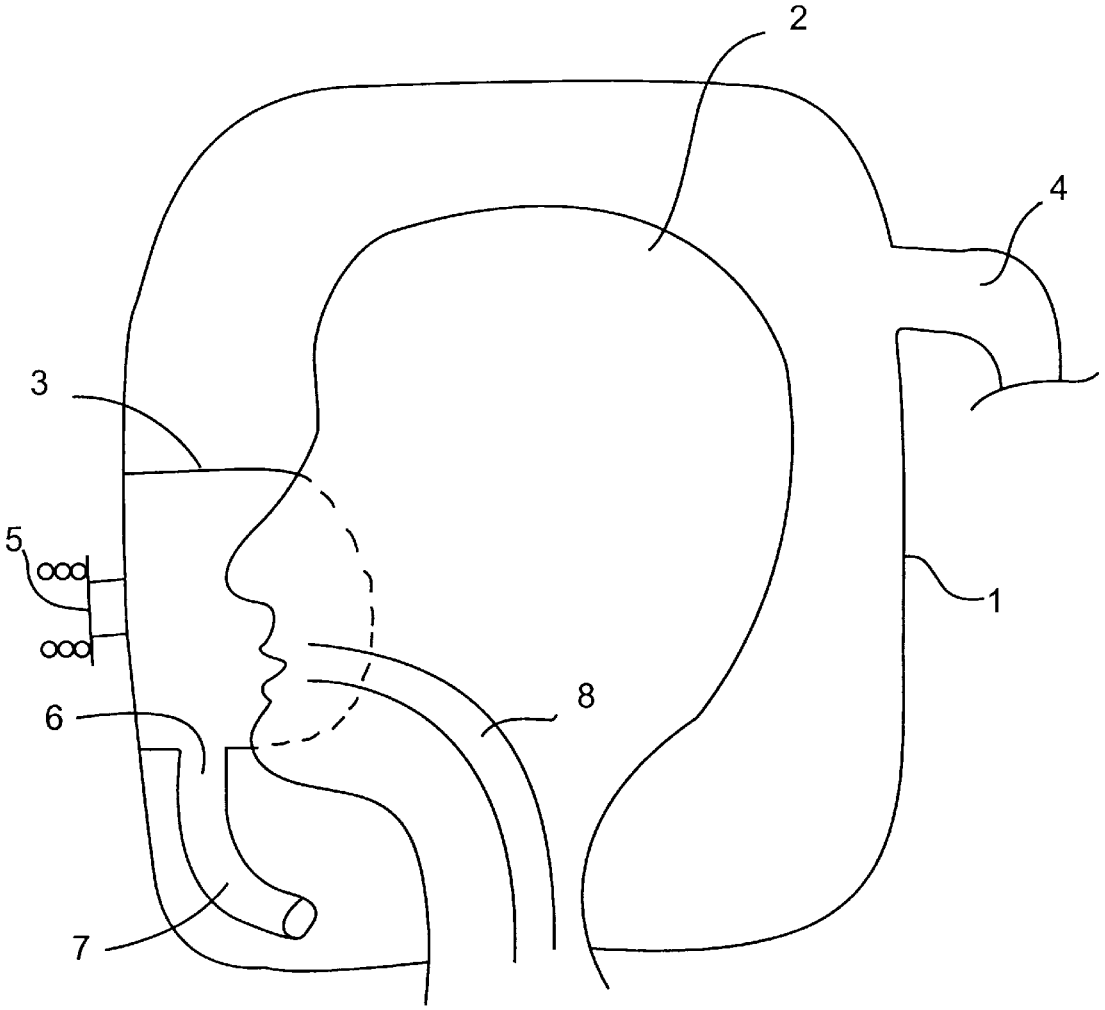
2
4
3
5
1
8
6
7

BREATHING EQUIPMENT

The present invention relates to breathing equipment of the kind which includes a breathing hood which is intended to cover the head of the wearer, an inner mask which covers at least the wearer's mouth and nose, a breathing gas supply conduit, means for enabling gas to flow from the hood to the mask, and check valve means for releasing gas from the mask to the surroundings when the overpressure in the mask has reached a given value.

Breathing equipment of this kind may include, for instance, a so-called escape or evacuation hood used temporarily when evacuating a building or a location filled with smoke or some other gas, possibly a toxic gas.

Breathing equipment of this kind which includes a breathing hood and an inner mask is described in U.S. Pat. No. 4,926,855. The breathing gas is passed directly to the mask in the case of this equipment. This means that unused breathing gas is able to flow into the surrounding hood together with exhalation gas and from there out to the surroundings via intentional leakage connections of the mask with the wearer's neck. When the breathing gas is delivered from a container of limited volume, this means that the gas consumption time can be seriously shortened in otherwise comparable conditions.

The U.S. patent specification proposes the use of a further valve means for overcoming this problem. This further valve means is operated, e.g., electrically and further complicates the equipment besides representing a further potential fault source.

WO 94/19055 describes another embodiment of breathing equipment which includes an outer hood and an inner mask. In the case of this equipment, breathing gas is delivered to the hood and as the wearer inhales is drawn into the mask via a check valve fitted in the wall between the mask and the hood. The exhalation gas exits to the surroundings via another check valve.

Although this equipment eliminates the risk of discharging unused breathing gas directly to the surroundings, problems can arise when the volume of breathing gas inhaled by the wearer exceeds the volume of breathing gas delivered to the hood. When the hood is made of a flexible material, this can result in the hood collapsing around the wearer's head at the same time as the amount of breathing gas delivered is insufficient to meet the wearer's need.

Furthermore, this equipment does not enable part of the exhaled gas to be breathed-in together with fresh gas, as does the equipment described in the aforesaid U.S. Pat. Specification No. 4,926,855. This restricts maximum ventilation.

The main object of the present invention is to provide breathing equipment of the aforediscussed general kind with which the aforesaid problems are eliminated, among other things, and which enables optimal use of the delivered breathing gas.

To this end, breathing equipment of the kind defined in the first paragraph is characterized in accordance with the invention by a combination whereby breathing gas is delivered to the hood and whereby means are provided for enabling gas to pass between the hood and the mask in both directions, wherein said means requires a lower overpressure in the mask for gas to pass from the mask to the hood than the over-pressure required by said check valve to allow gas to exit to the surroundings.

This equipment enables a certain volume of exhaled gas to be breathed and eliminates the risk of unused or fresh breathing gas passing directly to the surroundings.

In one particular advantageous embodiment of the invention, said means includes a gas passageway of given volume.

Among other things, this means that in each case the breathing gas last exhaled will not mix with the gas present in the hood, and that all gas present in the hood must flow through said passage in order to reach the mask. In the case of large ventilation equal to or greater than the volumetric flow of delivered breathing gas, all fresh gas will be delivered to the lungs of the wearer.

The aforesaid passageway is suitably formed by a conduit, preferably a flexible hose, having a volume in the magnitude of 0.2–1 liter.

Other features of the invention will be apparent from the following Claims.

The invention will now be described in more detail with reference to an exemplifying embodiment of inventive breathing equipment and also with reference to the accompanying drawing.

The drawing illustrates schematically a hood 1 which is suitably made of a flexible material and which surrounds the head 2 of a wearer. Disposed in the hood is a mask 3 which covers at least the wearer's mouth and nose. The mask 3 is suitably pressed into abutment with the wearer's face with the aid of the hood 1, which is joined to the mask.

The hood 1 is adapted to seat generally tightly around the wearer's neck, so that the hood interior can serve as a breathing gas container. Fresh breathing gas is delivered to the mask through a conduit 4, suitably in an essentially constant flow in the order of 35–70 liters per minute.

The mask 3 is connected to the surrounding atmosphere via a schematically illustrated spring-loaded check valve 5. The wall between the mask 3 and the interior of the hood 1 is provided with an opening 6 through which gas can pass in both directions. In the illustrated embodiment, the opening 6 communicates with the interior of the hood 1 via a hose section 7 of given volume, suitably a volume in the order of 0.2–1 liter. The opening 6 and hose 7 present a smaller resistance to the exhalation gas than the check valve 5. Part of the air passageways to the lungs are shown schematically at 8.

The aforedescribed embodiment operates in the following manner.

As the wearer inhales breathing gas is delivered to the wearer's lungs from the interior of the hood 1 through the hose 7 and the opening 6. The valve 5 is therewith closed. When the hood 1 is made of a flexible material, the hood will therewith flex inwardly towards the wearer's head when the volume of air inhaled is greater than the volume of gas delivered through the conduit 4 during inhalation.

As the wearer exhales, the exhalation gas will initially pass to the interior of the hood through the opening 6 and the hose 7. When the hood has returned to its initial form as a result of the increase in pressure generated by exhalation gas and breathing gas delivered through the conduit 4, the pressure in the mask 3 will also increase to a value at which the check valve 5 opens to the surroundings. Part of the exhaled gas will therewith depart to the surroundings in an amount which corresponds essentially to the volume of breathing gas delivered during the breathing cycle.

This embodiment ensures, among other things, that the volume of gas present in the air passageways 8 and the mask 3 at the beginning of an exhalation cycle, this air being considered to be essentially unused, is delivered to the hood 1 through the hose 7 for renewed inhalation during the next inhalation cycle. The check valve 5 will thus release to the surroundings the gas last exhaled from the lungs and having a relatively high $C0_2$ content.

The hose 7 will conveniently be flexible and given a length such as to enable it to contain a desired volume of exhaled gas that does not exit through the check valve 5.

The hose 7 ensures that the gas last exhaled will not mix with the gas in the hood 1, and that the gas which is forced out to the surroundings by the gas delivered through the conduit 4 at the end of an exhalation cycle is comprised of the gas last exhaled into the mask 3 and that present in the hose 7. The volume of gas in the hose 7 thus represents a buffer volume which ensures that no fresh air is able to enter the mask and accompany gas to the surroundings without having first passed through the lungs of the wearer.

Consequently, the described equipment ensures that all breathing gas metered to the mask is delivered to the lungs before exiting to the surroundings, particularly in the case of pronounced ventilation, therewith enabling the breathing gas to be used to an optimum. This enables the size of the breathing gas container to be reduced or the consumption time to be extended, for instance. This is achieved while maintaining good quality of the inhalation gas, a low $C0_2$ content.

It will be understood that the aforedescribed exemplifying embodiment can be modified in several respects within the scope of the following Claims. For instance, the illustrated hose 7 may be replaced with desired gas passage means of given volume to retain part of the exhalation gas. The mask 3 may also be provided with an opening 6 which communicates directly with the interior of the hood in the absence of an intermediate hose conduit. The opening may also include a valve adapted to open in the exhalation direction at a lower pressure than the check valve 5. The hood 1 and the mask 3 may, in other respects, be constructed in any suitable manner.

What is claimed is:

1. Breathing equipment of the kind which includes a breathing hood (1) intended to surround the wearer's head (2), an inner mask (3) which covers at least the wearer's mouth and nose, a breathing gas delivery conduit (4), means (6, 7) which permit gas to pass from the hood (1) to the mask (3), and check valve means (5) for allowing gas to pass from the mask (3) to the surroundings when the overpressure in the mask has reached a given value, characterized by the combination of that the breathing gas is delivered to the hood (1) and that said means (6, 7) allow gas to pass in both directions between hood (1) and mask (3); and further characterized in that said means (6, 7) requires a lower overpressure in the mask (3) for passage of gas from the mask to the hood than the pressure required for the check valve (5) to release gas to the surroundings.

2. Equipment according to claim 1, characterized in that said means includes a gas passageway (7) of given volume.

3. Equipment according to claim 2, characterized in that said gas passageway has the form of a conduit (7) having a volume in the order of 0.2–1 liter.

4. Equipment according to claim 3, characterized in that the conduit is a flexible hose (7).

5. Equipment according to claim 1, characterized in that the conduit (4) which delivers breathing gas to the hood (1) is adapted to deliver an essentially constant gas flow in the order of 35–70 l/min.

6. Equipment according to claim 1, characterized in that said means includes an opening (6) in the wall of the mask (3) facing the hood (1).

7. Equipment according to claim 1, characterized in that the hood (1) is made of a flexible material.

8. Equipment according to claim 1, characterized in that the mask (3) is fastened in the hood (1); and in that the hood is adapted to press the mask into sealing abutment with the wearer's face.

* * * * *